United States Patent [19]

Schuster

[11] Patent Number: 4,782,981

[45] Date of Patent: Nov. 8, 1988

[54] DISPENSER FOR TABLETS AND PILLS

[75] Inventor: Wilhelm Schuster, Frankfurt am Main, Fed. Rep. of Germany

[73] Assignee: Knoll AG, Fed. Rep. of Germany

[21] Appl. No.: 100,724

[22] Filed: Sep. 25, 1987

[30] Foreign Application Priority Data

Sep. 25, 1986 [DE] Fed. Rep. of Germany ..... 3632546

[51] Int. Cl.[4] ..... B65D 83/04

[52] U.S. Cl. ..... 221/265; 206/540; 222/370

[58] Field of Search ..... 221/196, 265; 206/534, 206/540; 222/370

[56] References Cited

U.S. PATENT DOCUMENTS

| | | | |
|---|---|---|---|
| 2,227,167 | 12/1940 | Warren | 221/265 |
| 2,979,230 | 4/1961 | Calverley | 221/196 X |
| 3,269,612 | 8/1966 | Bode | 222/370 X |
| 3,730,387 | 5/1973 | McConnell et al. | 222/370 X |
| 3,889,847 | 6/1975 | Uroskevick et al. | 206/540 X |
| 3,991,908 | 11/1976 | Thomas et al. | 221/265 X |
| 4,611,727 | 9/1986 | Graff | 221/265 X |
| 4,613,057 | 9/1986 | Sacchetti et al. | 221/265 |

FOREIGN PATENT DOCUMENTS

| | | |
|---|---|---|
| 3048865 | 7/1982 | Fed. Rep. of Germany . |
| 3344412 | 6/1985 | Fed. Rep. of Germany . |

*Primary Examiner*—F. J. Bartuska

*Attorney, Agent, or Firm*—Keil & Weinkauf

[57] ABSTRACT

A dispenser for shaped solids, in particular for tablets and pills of very small format, is described. In a cylindrical housing, a dosing device is inserted between a stock container and a collecting chamber, part of the dosing device being rotatable about the longitudinal axis of the housing. The dosing device consists of three parts, i.e. (a) a cylindrical ring part from whose inner wall a lug projects radially, (b) a dosing wheel which can be inserted into the ring part and rotated about the longitudinal axis of the housing, and (c) a base part which can be inserted into the dosing wheel. The dosing wheel has a perforated plate with dosing orifices arranged in the peripheral region. A rim projects at right angles from the peripheral edge of the perforated plate, locking notches assigned to the dosing orifices being provided on the inner wall of the rim. The base part is inserted into the rim of the dosing wheel and is provided with an ejection hole for the tablet or pill to be dispensed.

10 Claims, 5 Drawing Sheets

DISPENSER FOR TABLETS AND PILLS

The present invention relates to a dispenser for shaped solids, in particular tablets and pills of very small format, consisting of a cylindrical housing which consists of an upper part which is closed at one end and open at the other end, a dosing means provided with dosing orifices, and a lower part which encloses a collecting chamber, part of the dosing means being rotatable about the longitudinal axis of the housing.

German Laid-Open Application DOS No. 3,048,865 describes a dispenser, the cylindrical housing of which is provided with a stock chamber closed at one end by a stopper. The other end of the housing is closed by means of a wall having a sector-shaped cut-out, and at this point the housing has an extension which is displaced radially inward. A sleeve in which a sector-shaped dosing cell open in the axial direction is provided is pushed over this extension. The sleeve is rotatable on the extension in such a way that an accepting orifice of the dosing cell becomes aligned with the sector-shaped cut-out in the end wall of the housing, the dispensing orifice of the dosing cell then being closed by a cover. In this state, the dosing cell is charged. By rotating the sleeve, the dosing cell is closed off from the stock chamber and at the same time the dispensing orifice of the dosing cell is opened. Although such a dispenser is capable of dispensing tablets singly, controlled dosage cannot readily be achieved.

German Laid-Open Application DOS No. 3,344,412 discloses a dispenser, likewise cylindrical, for two or more components of a multiccmponent product which are stored separately from one another. The material to be dispensed here is of a special type. The dispenser consists of a store and a dosing disk which is rotatable about the store axis. It is composed of an upper part and a lower part, whose longitudinal axes are identical. The dosing disk divides the lower part into two chambers open at ends which are opposite one another, and has four annular webs displaced 90° with respect to one another, each of which defines a receiving compartment for a tablet. The upper part of the housing is provided with three cylindrical stock shafts for holding tablets or the like and an ejection shaft. When the lower part and upper part are joined together, the lower end surfaces of the shafts terminate shortly above the annular webs. When the lower part is rotated relative to the upper part about the longitudinal axis of the dispenser, cams and grooves which are provided engage one another. A tablet falls from a tablet shaft into a receiving compartment formed by the annular web on the dosing disk and can be tipped out by turning the dispenser upside down. This dispenser with its shafts and chambers, which is intended for a multicomponent product, is not easy to operate, and it is difficult for a layman to take solid and/or liquid medicaments from this dispenser in an appropriate manner.

The known dispensers for tablets or pills are, as a rule, designed for dispensing single units, without placing emphasis on controlled dosing. In these dispensers, moreover, no provision is made to ensure that tablets or pills are not damaged during dispensing. The situation is different when it is intended to dispense medicaments in tablet or pill form where the content of active compound is important.

There is a particular need for a means of dispensing microtablets in doses, microtablets being preferable to large tablets because they permit a substantially better distribution of active compound. Furthermore, the amounts of active compound present in small tablets or pills can be much more readily divided into patient-specific doses.

It is an object of the present invention to provide a dispenser of the type stated at the outset for microtablets and micropills, which combines simple handling with reliable dosing and reliable dispensing.

We have found that this object is achieved by a dispenser of the type stated at the outset if the dosing means consists of three parts, i.e. (a) a cylindrical ring part which can be inserted, with an exact fit, into the open end of the upper part of the housing and from whose inner wall a lug projects radially, (b) a dosing wheel which can be inserted into the open end of the ring part, which end faces away from the upper part of the housing, and rotated about the longitudinal axis of the housing and which has a perforated plate with dosing orifices arranged in the region of the peripheral edge and from whose peripheral edge a rim projects at right angles, whose inner wall is provided with locking notches assigned to the dosing orifices, and (c) a base part which can be inserted into the rim of the dosing wheel and has a plate from which an ejection hole has been cut out and from whose peripheral edge a continuous edge strip projects at right angles, on whose free edge is arranged a locking stud which interacts with the locking notches on the rim of the dosing wheel, the base part and the ring part being non-rotatably connected to one another in such a way that the lug of the ring part lies above the ejection hole of the base part.

Advantageous further embodiments of the dispenser are defined in the subclaims.

A dispenser having the features according to the invention is very suitable for microtablets and micropills which may contain the active compound in a very small dose, so that, depending on the dose he requires, the consumer can remove the number of tablets or pills in a simple manner by turning the dosing wheel forward stepwise. The features of the parts of the dosing means which interact with one another are matched with one another in such a way that, with each switching step, a tablet or pill can fall reliably from the stock chamber located above the perforated plate of the dosing wheel into the collecting chamber in the lower part of the housing. The user feels and hears when the locking stud of the base part snaps into a locking notch in the dosing wheel, and he therefore knows that a tablet or pill has now fallen into the collecting chamber. The upper part of the dispenser housing is pushed onto the ring part and closes the stock chamber. The lower part of the dispenser housing encloses the collecting chamber. By complementary ribs or grooves on the dosing wheel on the one hand and on the lower part on the other hand, these two parts are held together non-rotatably but can be detached from one another by pulling in order to remove tablets or pills.

The dispenser is illustrated in detail with reference to an embodiment shown in the drawings.

Figure 1:
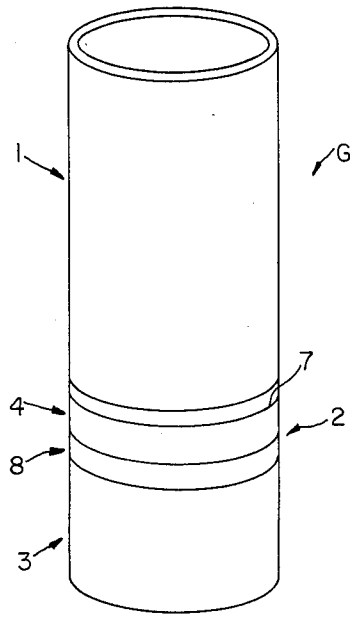
FIG. 1 shows a side view of an assembled dispenser.

The cylindrical housing G essentially consists of three parts, i.e. the upper part 1, the dosing means 2 and the lower part 3.

The upper part 1 together with part of the dosing means 2 forms a stock chamber 4. The lower part 3, which is placed on the dosing means 2 from below like a cap, encloses a collecting chamber 3' for the tablet or pill released from the stock chamber 4' by the dosing means 2.

The centerpiece of the dispenser is the dosing means 2. It consists of three parts, i.e. (a) a ring part 4, on which the upper part 1 of the housing G is mounted, (b) a dosing wheel 8, which is fitted into the free end of the ring part 4 from below, and (c) a base part 15, which is inserted into the dosing wheel 8 from below.

These three components are connected to one another in such a way that the ring part 4 and the base part 15 are held together non-rotatably, while the dosing wheel 8 inbetween can be rotated about the longitudinal axis, which is also the housing axis.

The ring part 4 is a cylindrical molding having a diagonal web 5 at that end of the ring part 4 which faces the upper part 1 of the dispenser. The web 5 has a central cut-out 5'. The outer circumference of the ring part 4 is provided with a continuous limiting web 7, on which the lower edge of the upper part 1 of the housing G rests. A triangular lug 6, which serves as a pusher for the tablet or pill to be dispensed, projects radially inward from the inner wall of the ring part 4. The ring part 4 forms the wall of the stock chamber 4' for the tablets or pills. The bottom of this stock chamber 4' is formed by a perforated plate 9 of the dosing wheel 8, which, as stated above, is inserted from below into the ring part 4, in which it fits tightly.

The dosing wheel 8 consists of a perforated plate 9 having essentially cylindrical dosing orifices 10 arranged at regular intervals along the peripheral edge. A conically tapering hub 11 which has a hole 11' is molded in the center of the upper surface of the perforated plate 9, which side points toward the upper part 1 of the housing G. A rim 12 which has an outwardly projecting step 12' projects downward, at right angles, from the peripheral edge of the perforated plate 9. This step 12' forms a stop for the lower edge of the ring part 4, in which the dosing wheel 8 is inserted so that it fits tightly and is rotatable. On the inner wall, advantageously in the lower region, of the rim 12 of the dosing wheel 8, locking notches 13 are provided, the said notches being arranged according to the dosing orifices 10 in the perforated plate 9 of the dosing wheel 8. In other words, a locking notch 13 is assigned to each dosing orifice 10.

Figure 2:
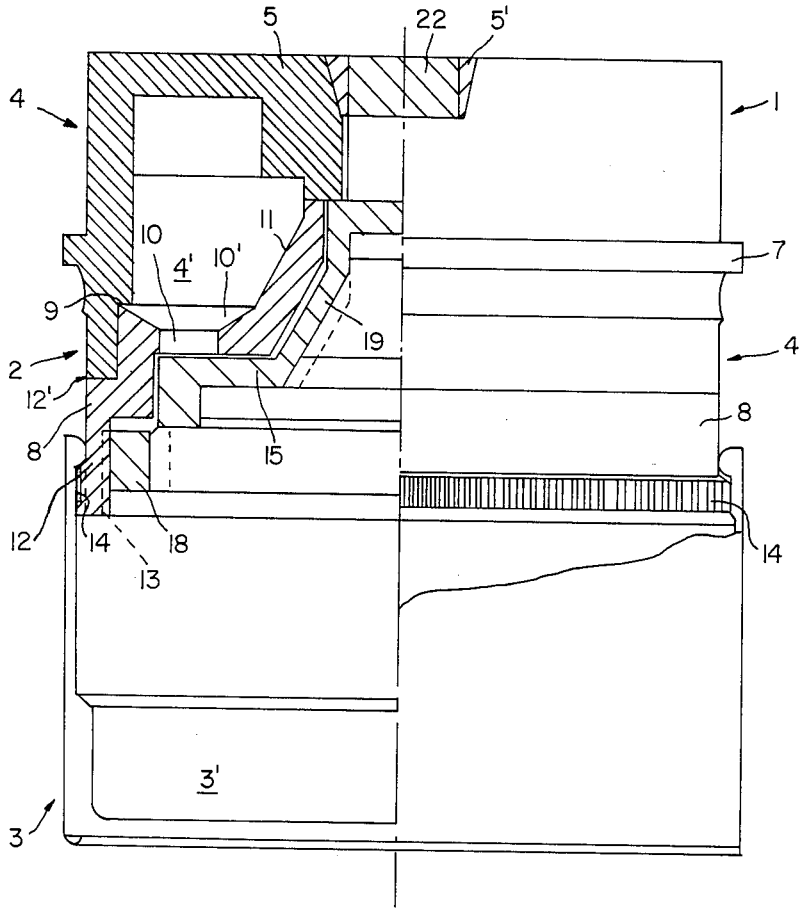
FIG. 2 shows an enlarged side view, partially in section.
Figure 3:
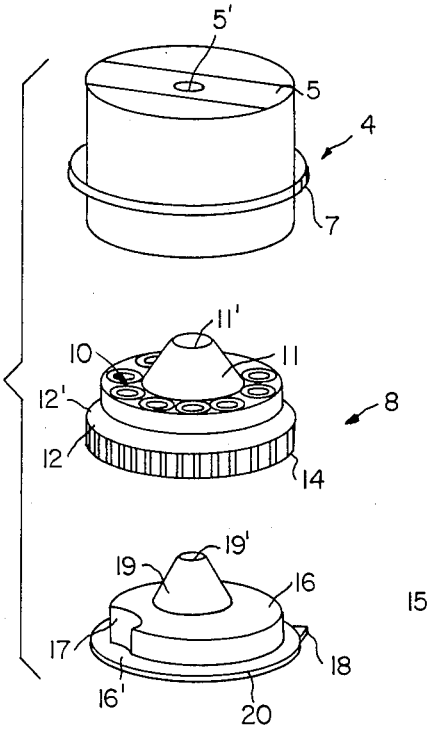
FIG. 3 is an exploded drawing of the three parts of the dispenser.
Figure 4:
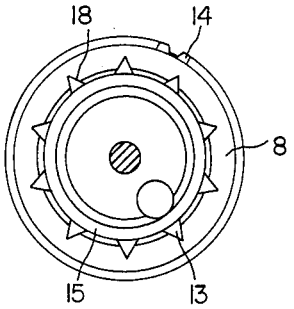
FIG. 4 shows a view from below of the base part inserted into the dosing wheel.

In a preferred embodiment, each dosing orifice 10 has a border (FIG. 2, 6 and 6*a*) which widens conically outward, forms a sort of funnel 10' and provides the transition from the surface of the perforated plate 9 to the perpendicular walls of the cylindrical dosing orifice 10.

Figure 6:
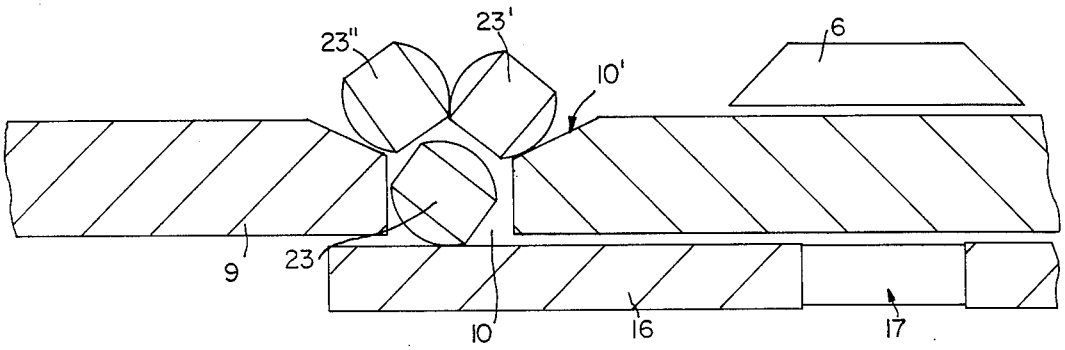
FIG. 6 shows an enlarged schematic representation of a section of the dosing wheel with pills present thereon.
Figure 6A:
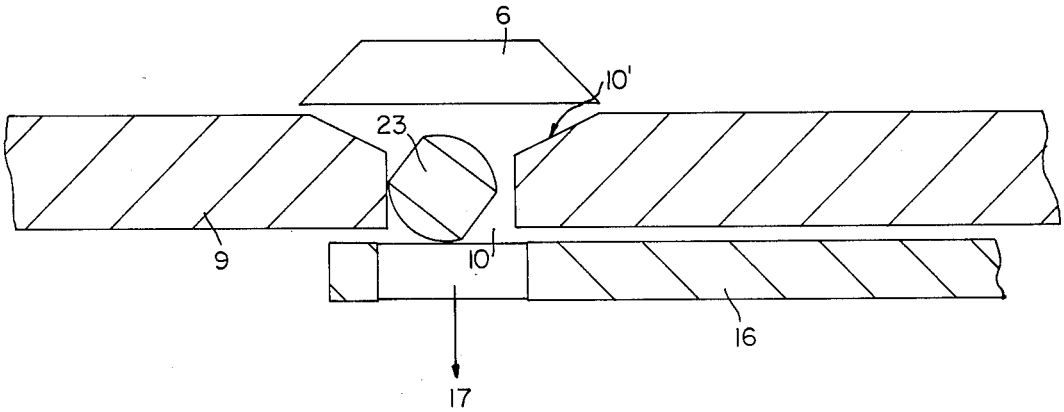
FIG. 6*a* shows a view which corresponds to FIG. 6 and in which a pill is present in a dosing orifice.

In this way, a sharp transition edge between the surface of the perforated plate 9 and the dosing orifice 10 is avoided. Thus, the tablet or pill pushed toward the dosing orifice 10 by the lug 6 cannot become jammed and be destroyed but slides downward along the inclined surface of the funnel 10' of the border and into the dosing orifice 10. The dimensions of the dosing orifice and of the tablets to be dispensed are matched with one another. In this connection, it is important that the internal diameter of the cylindrical dosing orifice 10 be slightly larger than the maximum diameter of the tablet. Furthermore, the height of the funnel cone is smaller than half the height or half the diameter of the tablet. This embodiment of the dosing orifice 10, matched with the dimensions of the tablets to be dispensed, and the arrangement of the lug 6 ensure satisfactory functioning of the dispenser. FIG. 6 and FIG. 6*a* illustrate the mode of operation. In FIG. 6, three pills 23, 23' and 23'' are present in the dosing orifice 10, but two of these pills rest on the funnel-shaped edge region 10'. When the dosing wheel 9 is turned further, the lug 6 moves against the pill 23', lifts it out and presses it against the pill 23'', which in turn is pushed away over the inclined wall of the funnel 10'. The dosing orifice 10 now contains only the pill 23, which falls out of the ejection hole 17 of the plate 16 of the base part 15.

The outer circumference of the dosing wheel 8, specifically that end which faces away from the ring part 4, is provided with ribs or grooves 14, onto which the lower part is pushed. The lower part 3 has corresponding ribs or grooves, so that the connection produced is sufficiently firm for the dosing wheel 8 to be carried along when the lower part 3 is rotated. However, the two parts can be detached from one another again by pulling. When the parts are separated, the ribs or grooves on the dosing wheel 8 and on the lower part 3 of the dispenser are no longer engaged, so that no tablets are dispensed even when the lower part 3 is rotated.

The base part 15 is inserted into the dosing wheel 8 from below. It consists of a plate 16 whose edge region contains an ejection hole 17 for the tablet or pill to be removed, the position of the said hole corresponding to the arrangement of the lug 6 on the ring part 4 and of the dosing orifices 10 in the perforated plate 9 of the dosing wheel 8. A conically tapering hub 19 which fits into the hub 11 of the dosing wheel 8 projects from the upper surface of the plate 16. The hub 19 of the base part 15 likewise has a hole 19'. A continuous edge strip 16' projects downward, at right angles, from the peripheral edge of the plate 19, and, on the lower peripheral edge of this edge strip 16', a locking stud 18 is formed, the said stud interacting with the locking notches 13 on the dosing wheel 8. For reliable and easier handling, this locking stud 18 is arranged on an arc, which is separated from the material of the edge strip 16' by a slot 20. As a result of this arrangement, the locking stud 18 is subjected to a spring force and, when the dosing wheel 8 is rotated, the said stud initially slides along the inner wall of the rim 12 until it snaps into a locking notch 13 under the spring force.

The three parts of the dosing means 2 are assembled in the order described above. The cut-out 5' and holes 11' and 19' of the ring part 4, of the dosing wheel 8 and of the base part 15 are aligned. These three components are then connected to one another by a fastening means inserted through the continuous opening. Such a fastening means may be a screw spindle (not shown) which holds the parts together when tightened. On the other hand, an extended, conically tapering hub 19 may be formed on the upper surface of the plate 16 of the base part 15, the said hub 19 being inserted through the hub 11 of the dosing wheel 8 and through the cut-out 5' in the web 5. A rivet head 22 is welded to the free end of this hub 19, i.e. to the piece which projects into the cut-out 5' of the web 5, and in this way the three components of the dosing means 2 are connected to one another. Satisfactory positioning of the parts with respect to one another is ensured by the unbreakable connection comprising the welded rivet head.

When assembling the three components, the ring part 4, the dosing wheel 8 and the base part 15, care must always be taken to ensure that the lug 6 in the ring part 4 comes to rest exactly above the ejection hole 17 in the base part 15. The base part 15 and the ring part 4 are non-rotatably connected to one another by the fastening means. On the other hand, the dosing wheel 8 held between these two parts is rotatable about the longitudinal axis of the housing G. Rotation is effected by means of the lower part 3 of the housing G, since this part is held non-rotatably on the dosing wheel 8 by the interlocking ribs or grooves.

Handling of the novel dosing means 2 is extremely simple and reliable. Since the lug 6 on the ring part 4 is always above the ejection hole 17, a tablet or pill will only be transported into this hole when the lug 6 gradually frees a dosing orifice 10 during rotation of the dosing wheel 8. The tablet or pill then slides into the dosing orifice 10 and from here into and through the ejection hole 17 and into the collecting chamber 3' of the lower part 3 of the housing G.

Since a locking notch 13 is assigned to each dosing orifice 10, a tablet or pill is transported through the corresponding dosing orifice each time the locking stud 18 of the base part 15 engages a locking notch 13.

Figure 5:
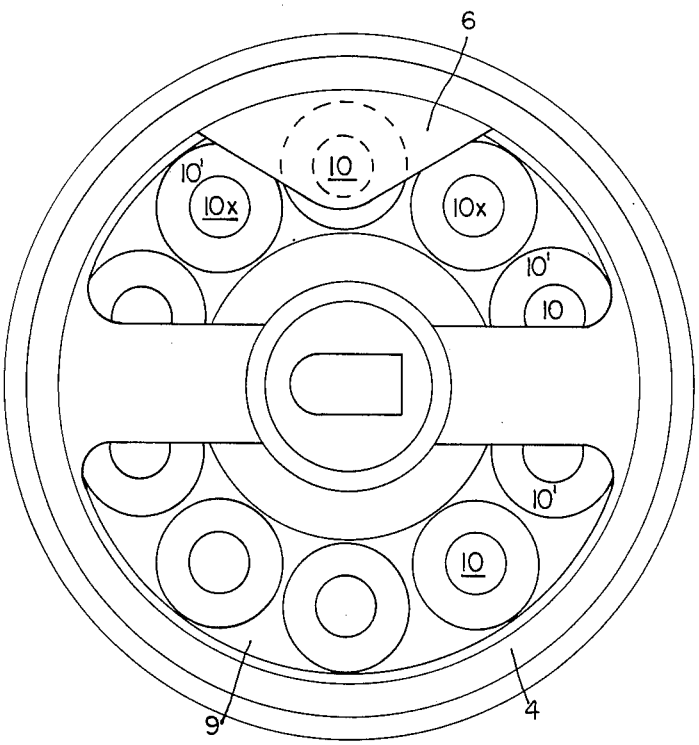
FIG. 5 shows a plan view of the assembled dosing means with the upper part of the housing removed.

In addition to the shape of the dosing orifice and the matching of its size with the tablets to be dispensed, an appropriate design of the lug 6 on the ring part 4 of the dosing means 2 also ensures that tipping and hence destruction of the tablet or pill to be dispensed is avoided. For this purpose, the shape and size of the lug 6 is chosen so that, when at rest, it completely covers a dosing orifice 10 and its two sides 6' are each roughly tangential to the dosing orifices 10*x* adjacent to the covered dosing orifice 10 (FIG. 5).

The lug 6 is preferably slightly springy and thin in order to ensure that the tablets or pills 23 are carefully handled and moved.

I claim:

1. A dispenser for shaped solids, in particular tablets and pills of very small format, consisting of a cylindrical housing which consists of an upper part which is closed at one end and open at the other end, a dosing means provided with dosing orifices, and a lower part which encloses a collecting chamber, part of the dosing means being rotatable about the longitudinal axis of the housing, wherein the dosing means (2) consists of three parts, i.e. (a) a cylindrical ring part (4) which can be inserted, with an exact fit, into the open end of the upper part (1) of the housing and from whose inner wall a lug (6) projects radially, b) a dosing wheel (8) which can be inserted into the open end of the ring part (4), which end faces away from the upper part (1) of the housing, and rotated about the longitudinal axis of the housing (G) and which has a perforated plate (9) with dosing orifices (10) arranged in the region of the peripheral edge and from whose peripheral edge a rim (12) projects at right angles, whose inner wall is provided with locking notches (13) assigned to the dosing orifices (10), and c) a base part (15) which can be inserted into the rim (12) of the dosing wheel (8) and has a plate (16) from which an ejection hole (17) has been cut out and from whose peripheral edge a continuous edge strip (16') projects at right angles, on whose free edge is arranged a locking stud (18) which interacts with the locking notches (13) on the rim (12) of the dosing wheel (8), the base part (15) and the ring part (4) being non-rotatably connected to one another in such a way that the lug (6) of the ring part (4) lies above the ejection hole (17) of the base part (15).

2. A dispenser as claimed in claim 1, wherein a diagonal web (5) having a central cut-out (5') is arranged on that end of the ring part (4) which faces away from the lug (6), the said cut-out being aligned with a central hole (11') in the perforated plate (9) of the dosing wheel (8) and with a central hole (19') in the plate (16) of the base part (15), and the three parts of the dosing means (2) are connected to one another by a screw spindle inserted through the holes and the cut-out (19', 11' and 5').

3. A dispenser as claimed in claim 1, wherein a conically tapering hub (11) is formed on the upper surface of the perforated plate (9) of the dosing wheel (8), the said hub coming into contact with the underneath of the web (5) on the ring part (4) in the assembled dosing means (2).

4. A dispenser as claimed in claim 1, wherein the dosing orifices (10) in the perforated plate (9) of the dosing wheel (8) are essentially cylindrical, and each dosing orifice (10) is widened toward the surface of the perforated plate (9) and is bordered by an edge region which runs conically outward in the form of a funnel (10').

5. A dispenser as claimed in claim 1, wherein the internal diameter of each dosing orifice (10) is slightly larger than the maximum diameter of a tablet to be dispensed, and the height of the funnel (10') is smaller than half the height or than half the diameter of the tablet or pill (23).

6. A dispenser as claimed in claim 1, wherein the lug (6) is slightly springy and is arranged on the inner wall of the ring part (4) in such a way that, when the dosing wheel (8) is rotated, the said lug moves parallel to the perforated plate (9) and sweeps directly above its surface.

7. A dispenser as claimed in claim 4, wherein the lug (6) is triangular and is shaped so that its sides (6') are tangential to the respective peripheral edge of two dosing orifices (10*x*, 10*x*; FIG. 5) which are adjacent to a dosing orifice (10) which is covered by the lug (6).

8. A dispenser as claimed in claim 1, wherein a conically tapering hub (19) projects from the upper surface of the plate (16) of the base part (15), the said hub being inserted through the hub (11) of the dosing wheel (8) and through the cut-out (5') in the web (5), and a rivet head (22) is welded to the free end of this hub (19).

9. A dispenser as claimed in claim 1, wherein the locking stud (18) of the base part (8) is formed on an arc separated from the peripheral edge of the edge strip (16') by a slot (20), and is held under spring tension by this and can snap into the locking notches (13) on the ring part (4).

10. A dispenser as claimed in claim 1, wherein, in the assembled dosing means (2), the base part (15) is sunk into the dosing wheel (8), and the outer circumference of the dosing wheel (8) is provided with ribs or grooves (14) which interact with corresponding ribs or grooves in the inner edge of the lower part (3) of the housing (G), which lower part is to be placed on top as a cap.

* * * * *